US005180317A

United States Patent [19]

Franks, Jr.

[11] Patent Number: 5,180,317

[45] Date of Patent: Jan. 19, 1993

[54] ANGLED ELECTRICAL CONNECTOR

[76] Inventor: George J. Franks, Jr., 664 Thompson Cir., Inverness, Ill. 60067

[21] Appl. No.: 829,126

[22] Filed: Jan. 31, 1992

[51] Int. Cl.[5] ..... H01R 13/00

[52] U.S. Cl. ..... 439/669

[58] Field of Search ..... 439/668, 669, 690, 695, 439/476, 582, 675

[56] References Cited

U.S. PATENT DOCUMENTS

| | | | |
|---|---|---|---|
| 1,970,149 | 8/1934 | Pugh, Jr. | 439/669 |
| 2,238,834 | 4/1941 | Travers | 439/669 |
| 3,435,163 | 3/1969 | Bailey et al. | 439/668 |
| 4,647,127 | 3/1987 | Weingartner . | |

*Primary Examiner*—Joseph H. McGlynn

*Attorney, Agent, or Firm*—Jenner & Block

[57] ABSTRACT

A right angle shielded connector includes an elongated shaft having connector surfaces and an opposite head portion with a flange which is slidably received within a groove around a slot in a shell cap. The slot extends through the upper portion of the cap and a lower threaded portion of cylindrical shape except for the slot extending therethrough. A cylindrical threaded bushing screws onto the lower threaded portion and snugly against the flange. A pair of terminals are located within the hollow interior of the shell cap and are keyed to prevent rotation once assembled. Prior art right angle connectors are also illustrated in which the shell cap are formed from two halves of a cover which mate together.

17 Claims, 2 Drawing Sheets

Fig. 1
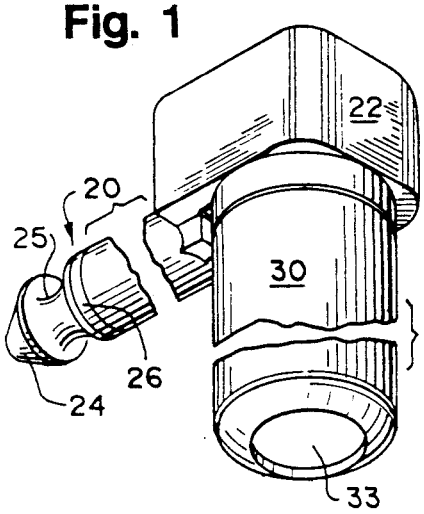
Fig. 2
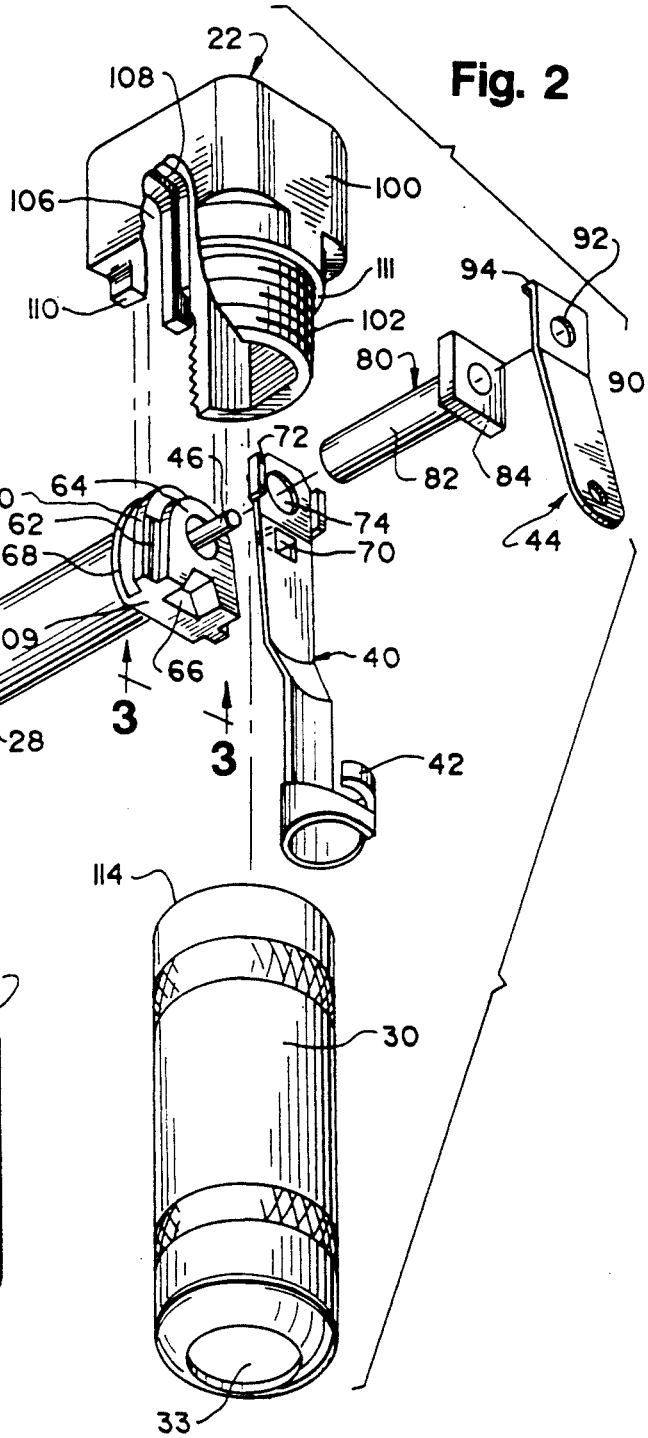
Fig. 4
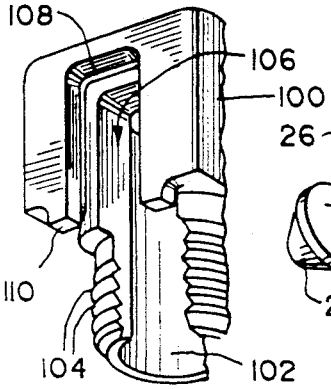
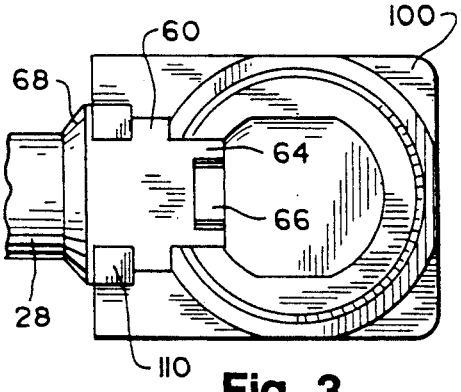
Fig. 3

Fig. 5 PRIOR ART
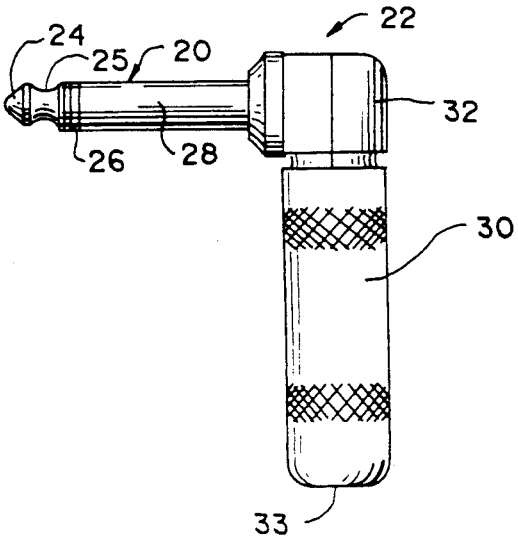
Fig. 7 PRIOR ART
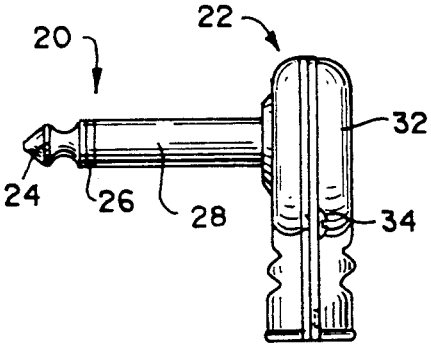
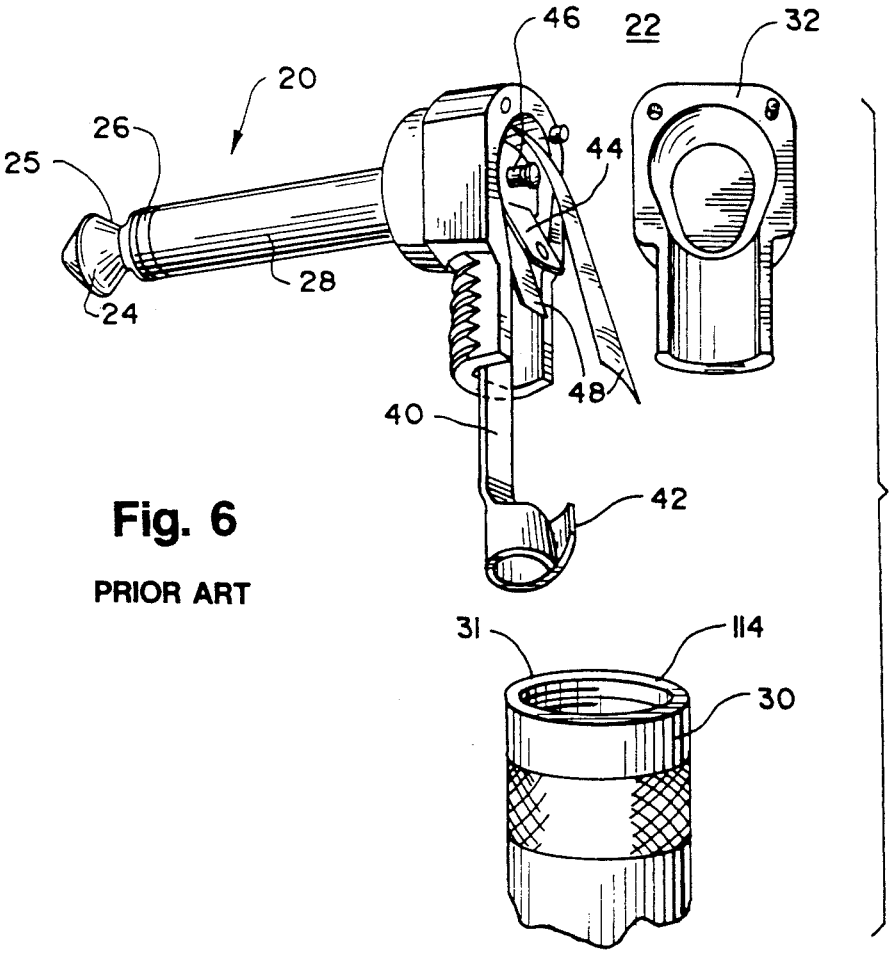
Fig. 6
PRIOR ART

ANGLED ELECTRICAL CONNECTOR

FIELD OF THE INVENTION

This invention relates to an electrical connector for terminating an electrical cable having one or more conductors, and is particularly useful for a right angle connector plug in which the elongated shaft is skewed at an angle to a threaded bushing and the cable which extends therefrom. More specifically, the invention relates to an improved electrical connector, such as shielded connector, which is structurally strong and easily assembled during the manufacturing operation as well as by the end user.

BACKGROUND OF THE INVENTION

The interconnection of various electronic and electrical systems typically requires that a cable containing one or more conductors terminates in an electrical connector which removably mates with a receptacle. Examples of electrical connectors are quarter-inch phone plugs having an elongated male shaft which is plugged into a female jack having connectors for mating engagement with surfaces on the shaft. Often it is desirable that the elongated shaft be at an angle such as 90° to the threaded shield so that the inserted plug does not protrude much beyond the jack bearing panel. Because of their manner of use, right angle connectors often have increased stress caused by insertion and removal forces as contrasted with the standard in-line configuration in which the elongated shaft and the threaded shielded bushing and extending cable are coaxial. They also are more prone to breakage than an in-line connector.

Conventional right angle connectors are typically formed by a housing formed from separate pieces which are joined together. One of the pieces may be integral to the elongated shaft. These separate pieces may each contain a partial annular thread and when mated together allow a threaded bushing with an internal thread to join together and hold the individual pieces. However, such a structure is more liable to breakage, forms a less effective shield, and the increased number of parts are individually and collectively less structurally sound than is desirable. Also, the number of pieces of the plug which must be assembled by the end user after connection is made to a cable should be minimized particularly to reduce labor costs in industrial and commercial applications. Unfortunately, these requirements often conflict with the need to form a structurally secure right angle connector.

SUMMARY OF THE INVENTION

In accordance with the present invention, a novel angled electrical connector is disclosed that is mechanically strong, easily assembled and minimizes the number of parts which the end user needs to assemble after connecting a cable to the connector. The electrical connector includes a cap housing having a slot for receiving a head portion of an elongated shaft. The cap housing is substantially more solid than has been typical in the prior art, and is structurally more sound and forms a better shield. The end user needs to join only two pieces after connecting a cable to the connector terminals, as contrasted with three or more pieces in many right angle connectors.

The present electrical connector is particularly adapted to form a shielded plug, such as a quarter-inch audio phone plug or the like. However, the improved connector is useful whether or not the plug is to be shielded, and reduces the forces which cause breakage and difficulty in assembly. The connector is easily assembled during the manufacturing process and yet results in an improved structure.

BRIEF DESCRIPTION OF THE DRAWINGS

FIG. 1 is a perspective view of a right angle connector according to the present invention;

FIG. 2 is a partially exploded perspective view of the connector of FIG. 1, in which certain portions have been cut-away for clarity of illustration;

FIG. 3 is a partial sectional elevation taken along lines 3—3 of FIG. 2 when the elongated shaft assembly is located within the slot of the shell cap;

FIG. 4 is a perspective view of the shell cap of FIGS. 1 and 2 when rotated 90° therefrom to better illustrate the slot opening therein;

FIG. 5 is a side elevational view of a prior art type of right angle connector;

FIG. 6 is a partially exploded perspective view of the prior art connector of FIG. 5; and FIG. 7 is a side elevational view of another embodiment of a prior art connector.

DESCRIPTION OF THE PREFERRED EMBODIMENT

FIGS. 1–4 illustrate a novel electrical connector embodied in a right angle phone plug which is used to connect an electrical cable to a jack or receptacle of standard design. FIGS. 5–7 illustrate right angle phone plugs which are typical in the prior art. All such electrical connectors typically include an elongated connector assembly 20 which extends from a shell or cap assembly 22 which contains therein at least one terminal which can be soldered to an electrical conductor of a cable (not illustrated). The cable may be a shielded cable in which a center wire conductor extends through a surrounding shield which is to be connected to the cap assembly 22, or alternatively, the cable could contain a plurality of electrical conductors.

The elongated connector assembly 20 has a terminating tip end 24 with a detent groove 25 spaced from the tip end which forms one electrical contact which mates with a contact in the receiving jack. A detent spring on the jack engages the groove 25 as is conventional. Adjacent the tip end 24 is an annular spacer or insulator 26 which electrically isolates the tip from an annular hollow outer shaft 28 which forms a second electrical contact surface. The receptacle jack, as is well known, includes contacts which engage the surface 28 in order to electrically connect the plug to circuitry to which the receptacle jack is attached.

While a right angle audio connector of the shielded type is illustrated, in which the contact tip 24 is connected to a center wire of a shielded cable, and the surrounding shaft 28 and cap assembly 22 are formed of metal and are electrically connected to the shield of the cable, other types of electrical connectors are suitable for use with the invention. For example, the elongated shaft assembly 20 may have additional electrical contact surfaces separated by additional insulators in order to form a connector for a multiple wire cable.

In both the novel connector of FIGS. 1–4 and the prior art embodiment of FIGS. 5–6, the cap assembly 22 is threaded onto a metal annular cover or bushing 30. The bushing 30 is of a hollow cylindrical shape having interior threads 31 (see FIG. 6) adjacent one open end thereof. A circular aperture 33 is located at the other end for the cable to extend into the bushing 30. Such a threaded bushing 30 may be identical to the form used with an in-line connector. This provides economies of scale in the manufacturing process as well as bushing parts which are interchangeable for a family of in-line and right angle connectors.

In typical prior art connectors such as seen in FIGS. 5–6 and FIG. 7, the cap assembly 22 is often formed of two parts or halves, the front of which is joined to or may be an integral part of the elongated shaft assembly 20. A rear half 32 mates to the front half and may be connected thereto in a variety of manners. In the connector of FIGS. 5–6, the front half and the rear half each form about one half of an exterior threaded cylinder. When abutted together, the external threads form a complete cylinder which is held together by the bushing 30 when threaded onto the abutting pieces. In the type of prior art connector shown in FIG. 7, the rear cover 32 is secured to the front cover by a pair of screws 34. Typically, the connector of FIG. 7 does not form as good a shield as the other connectors but it is more inexpensive to manufacture. In addition, the screws 34 or other fasteners can be lost and are more labor intensive for the end user to assemble together after the cable has been secured to the terminals located inside the cover.

The right angle connector of FIGS. 1–4 and the prior art right angle connector of FIGS. 5–6 each include a long terminal 40 having a clamp or crimp end 42 which may be connected to the shield conductor of the cable. The center wire of the cable is connected to a short terminal 44 which mechanically and electrically connects to an inner shaft 46 which extends within the hollow outer shaft 28 to the front terminal tip 24. The inner shaft 46 is of reduced diameter and electrically isolated from the outer surrounding shaft 28 and extends down the hollow center thereof into engagement with the tip end 24 and may be formed as an integral part of the tip 24. The opposite end of the inner shaft 46 is staked to the short terminal 44 or has an enlarged head to mechanically and electrically join them together. A pair of insulating ribbons 48, seen only in FIG. 6, may be used if desired to aid in electrically isolating the terminal 44 and the center wire of the cable when soldered thereto from the surrounding metal cap assembly 22. The electrical connectors, to the extent described above, are generally conventional and may be varied as is known.

The aspects which are novel with respect to the prior art will now be explained. The elongated connector assembly 20 of FIGS. 1–4 includes a head section seen best in FIGS. 2 and 3. A flange 60 surrounds the outer shaft 28 and a plurality of interference ribs 62 are located on the side surfaces of the flange. The interference ribs 62 are V-shaped and their purpose will be described later. Adjacent the flange 60 is the terminating neck or end 64 of the outer shaft 28. This neck 64 is of reduced diameter compared to the flange 60. A cylindrical aperture extends through the entire outer shaft 28 to create the hollow interior through which the inner shaft 46 extends in spaced relationship to the outer shaft 28. Located in the bottom of the neck 64 is a key recess 66. A generally conical skirt 68 is spaced a distance in front of the flange 60. The rear surface of the skirt 68 is flat. The space between the skirt 68 and the flange 60 forms a notch or deep groove generally surrounding the head except for the bottom section thereof.

The long terminal 40 is formed of a metal lug with a tab 70 which is bent at a right angle to the longitudinal extent of the terminal and towards the shaft assembly 20. A pair of bends 72 extend from the sides of the end of the long terminal opposite the clamp end 42. Centered within the bends 72 is a circular aperture 74 of the same diameter as the diameter of the hollow center of the outer shaft 28. A rear insulator 80 is comprised of a hollow tubular shaft 82 and a square head 84. Extending through the rear insulator 80 is a cylindrical aperture just slightly larger than the diameter of the inner shaft 46 in order to be slidably mountable thereon. The outer diameter of the insulator shaft 82 is just slightly smaller than the diameter of the circular aperture 74 and the hollow interior of the outer shaft 28.

The short terminal 44 is formed of a lug having a metal lug hole 90 for soldering to the center wire of the cable, and at the opposite end of the lug a circular aperture 92 of the same diameter as the circular aperture extending through the rear insulator 80. The short terminal 44 also includes a key or bend 94 located at the top thereof.

During assembly by the manufacturer of the plug, the aperture 74 of the long terminal 40, the hollow aperture of the rear insulator 80, and the aperture 92 of the short terminal 44 are inserted through the inner shaft 46. The inner shaft 46 then extends slightly beyond the aperture 92 in the short terminal 44, and the inner shaft 46 is then staked in a conventional manner so as to secure together the shaft assembly 20, the long terminal 40, the insulator 80 and the short terminal 44. Alternatively, the inner shaft 46 may be formed separate from the tip 24 and consist of an enlarged flattened head adjacent the terminals and a serrated end adjacent the tip 24 which would contain a mating aperture therein. The nail like inner shaft 46 would be driven into the tip 24 with the enlarged head forming the stake or mounting surface to secure the short terminal 44 and sandwiched insulator and long terminal to the head of the assembly 20.

The tab 70 of the long terminal extends into the key access 66 to prevent rotation therebetween. The tab 70 may be bent into the key recess 66 during the assembly operation, if desired. The bends 72 on the long terminal snugly fit against the outer sides of the square insulator head 84. This keys together the parts to prevent the insulator 80 from rotating within the assembled unit. In turn, the bend 94 on the short terminal extends over the top of the square head 84 to key it and prevent rotation when the inner shaft 46 is staked to the terminal 44. The bend 94 extends less than the thickness of the square head 84 so as to maintain electrical isolation between the pair of terminals 40 and 44. The bends 72 and 94 may each be formed during the assembly operation, if desired. Alternatively, the recess 66 can be eliminated and one or more of the bends 72 can extend oppositely over the narrow neck 64 which serves as a key surface. The inner insulator 80 can be formed solely by a space head 84 with the parts being shaped so as to key together the parts to prevent rotation.

The shell cap or joint 22 is best seen in FIGS. 1, 2 and 4. It consists of an upper hollow housing 100 of generally cube shape. Integrally connected thereto is a lower generally cylindrical member 102 containing exterior threads 104 which mate with the interior threads located in the hollow bushing 30. Extending through the upper body 100 and lower body 102 is an elongated slot 106 which forms a generally rectangular opening through the otherwise solid side surfaces of the cap housing 22. The surrounding walls of the cap around the slot 104 contain a groove 108 which will slidably receive the flange 60 of the shaft assembly 20.

The completed connector assembly 20, which includes the long terminal 40, spacer 80 and short terminal 44 joined thereto, is pushed into the slot 106 of the cap 22 by aligning the flange 60 with the groove 108 and pushing the units together. As the units are slid together, the interference ribs 62 slide inside the groove 108 to create a force fit that snugly holds together the cap 22 and shaft and terminal assembly. The flange 60 extends completely into the surrounding groove 108 to seal mechanically and electrically the opening otherwise contained in the upper body 100 of the cap 22. The skirt 68 slides snugly against the outer side of the housing 100, see FIG. 3, and abuts the housing to strengthen the extending shaft 28 against forces which would tend to snap or bend the elongated shaft out of its 90° or normal position to the flat side of the housing 100. The head 60 includes a bottom surface 109 which is generally flat. When the flange 60 is fully inserted into the groove, the bottom 109 is flush with the bottom surfaces 110 of the upper body 100 and with an annular bottom seat 111 surrounding the upper body 100 where it joins the threaded lower section.

In effect, the customer or end user is supplied with a two-piece connector consisting of the integral shaft connector 20 and cap 22, and the separate threaded bushing 30. When the customer desires to use the connector, the cable is placed through hole 31 of the bushing 30 and the center wire of the cable is soldered within aperture 90 of the short terminal 44. The outer shield may be crimped by the clamp 42 or otherwise soldered or connected to the long terminal 40. The bushing 30 is then screwed onto the exterior threads 102 until the top annular rim 114 of the bushing 30 abuts the annular seat 111 of the upper body 100 including portions of the bottom surface 109 of the outer shaft. Since the bushing 30 as well as the cap 22 and outer shaft 28 are all formed of conductive metal, a good shield is formed for the inner wire of the cable once the bushing 30 is tightly screwed against the bottom seat surfaces of the joined shaft assembly.

The cap housing 22 is substantially more solid than prior cap housing units. The threads 102 extend around a greater circumference than the illustrated prior art connectors, with only the slot 106 interrupting the otherwise completed cylinder formed by the threads. Once the shaft assembly 20 is snugly secured within the groove 108 of the slot opening 106 with the skirt 68 abutting the outer surface of the upper housing, a fairly rigid structure is created which is stronger than the typical prior art devices. The strength of the connector assembly helps to reduce breakage. The part count of pieces for final assembly by the end user or customer has been reduced. Also, the cap 22 is more solid and forms a better shield than prior art caps 22 as seen in FIGS. 5–7 in which a split occurs in the top of the cap caused by separate pieces or halfs which must be mated together.

While the connector has been shown for a typical shielded audio plug having a pair of contacts 24 and 28 along an elongated shaft, it will be appreciated that numerous variations can be made. The electrical conductor can be used with or without a shielded cable as desired. The connector can be made in male or female form and for cables using one or multiple conductors. Other changes are intended to be within the spirit of the invention and can be made by one skilled in the art.

What is claimed is:

1. An electrical connector, comprising:

an elongated connector assembly having at least one contact surface spaced along an elongated shaft for mating contact with a receptacle, a head portion located adjacent one end of the elongated shaft, and at least one terminal extending from the head portion and electrically connected to the content surface of the elongated shaft, a shell assembly at least partially surrounding the terminal and including a threaded surface and a slot located in the shell assembly for mounting the head portion to attach the elongated connector assembly to the shell assembly, and a threaded bushing member for mating engagement with the threaded surface of the shell assembly to form therewith a housing which surrounds the terminal.

2. The electrical connector of claim 1 wherein the head portion of the connector assembly includes a skirt which extends from the elongated shaft and abuts the outer surface of the shell assembly.

3. The electrical connector of claim 1 wherein the threaded bushing member is cylindrical with an annular end surface, the head portion of the connector assembly includes a bottom surface aligned so as to be flush with a sealing surface on the head assembly when the head portion is fully inserted into the slot, and the annular end surface of the bushing member abutting against the sealing surface and at least a portion of the bottom surface when the bushing member is completely threaded onto the shell assembly.

4. The electrical connector of claim 1 wherein the elongated connector assembly further includes an insulator having an insulator body with an edge located thereon, and the terminal includes a tab extending over the edge for keying the terminal against movement.

5. The electrical connector of claim 1 wherein said terminal extends from the head portion at generally a right angle with respect to the axis of the elongated shaft, the threaded surface of the shell assembly being generally cylindrical and generally coaxial with the terminal so that the threaded bushing member when screwed on the shell assembly extends at generally a right angle to the elongated shaft.

6. The electrical connector of claim 1 wherein the shell assembly includes a groove surrounding the slot, and the head portion of the connector assembly includes a flange which is slidably received within the groove to secure and mount the elongated connector assembly to the shell assembly.

7. The electrical connector of claim 6 wherein said flange includes a plurality of interference ribs which abut the surface of the groove when slidably received therein.

8. The electrical connector of claim 6 wherein said the flange extends outwardly from a neck of reduced diameter, an inner shaft extending from the contact surface of the elongated shaft and through the neck into contact with the terminal, the flange being located close to the neck and closing the slot when the flange is slidably received within the groove of the shell assembly.

9. The electrical connector of claim 8 wherein the neck includes a key surface located thereon, a second terminal extending from the head portion and including a tab which extends against the key surface to prevent rotation between the second terminal and the elongated shaft.

10. The electrical connector of claim 1 wherein the threaded surface of the shell assembly is annular in the shape of a substantially complete cylinder except for the slot located therein.

11. The electrical connector of claim 10 including a second terminal extending from the head portion, the insulator being sandwiched between the first named terminal and the second terminal to electrically isolate the terminals, and the second terminal including a member in abutment with the insulator to key the second terminal against rotation within the elongated connector assembly.

12. An electrical connector, comprising:

an elongated connector assembly having at least one contact surface spaced along an elongated shaft for mating contact with a receptacle, at least one terminal extending from an end section of the elongated shaft, and a flange surrounding the end section and extending therefrom, a shell member having an opening located in one surface means for mounting the flange to the shell member so that the flange covers the opening and orients the terminal at least partially within the shell member and extending generally at a right angle to the elongated shaft, and a cover member for mating engagement with the shell member to form therewith an elongated housing which surrounds the terminal and extends generally at a right angle to the elongated shaft.

13. The electrical connector of claim 12 including a second terminal extending from the end section of the elongated shaft, an insulator located between the first named terminal and the second terminal for isolating the terminals, means for electrically connecting the terminals individually to different spaced contact surfaces along the elongated shaft, and key means for keying together the terminals and the elongated shaft to prevent rotation therebetween.

14. The electrical connector of claim 12 wherein the shell member comprises an upper housing section which contains the opening therein and an integral lower section of generally cylindrical shape having a threaded surface at least partially surrounding the same, and the cover member includes a generally cylindrical threaded surface for engagement with the threaded surface of the lower section to attach the cover member to the shell member.

15. The electrical connector of claim 14 wherein the means for mounting includes a groove surrounding the opening in the one surface of the shell member for slidably receiving within the groove the flange of the connector assembly.

16. The electrical connector of claim 12 wherein the shell member comprises an upper housing portion and a generally cylindrical lower portion extending therefrom and containing a fastener surface on the lower portion, the opening extending through the upper portion and the lower portion of the shell member, the means for mounting causing the flange to cover the portion of the opening located in the upper portion, and the cover member covering the remaining portion of the opening located in the lower portion of the shell member.

17. The electrical connector of claim 16 wherein the elongated connector assembly further includes a skirt spaced from the flange, the skirt abutting an outer surface of the upper housing portion to provide additional support for the elongated shaft.

* * * * *